US010807823B2

(12) United States Patent
Hoffman et al.

(10) Patent No.: US 10,807,823 B2
(45) Date of Patent: Oct. 20, 2020

(54) CARD STACKER

(71) Applicant: Assa Abloy AB, Stockholm (SE)

(72) Inventors: Ted M. Hoffman, Eden Prairie, MN (US); Tanya Snyder, Edina, MN (US); John Skoglund, Prior Lake, MN (US)

(73) Assignee: ASSA ABLOY AB, Stockholm (SE)

( * ) Notice: Subject to any disclaimer, the term of this patent is extended or adjusted under 35 U.S.C. 154(b) by 0 days.

(21) Appl. No.: 16/265,267

(22) Filed: Feb. 1, 2019

(65) Prior Publication Data

US 2020/0247637 A1 Aug. 6, 2020

(51) Int. Cl.

| | |
|---|---|
| ***B65H 29/46*** | (2006.01) |
| ***B65H 5/06*** | (2006.01) |
| ***B65H 29/14*** | (2006.01) |
| ***B65H 31/00*** | (2006.01) |
| ***B65H 29/22*** | (2006.01) |

(52) U.S. Cl.

CPC ..... *B65H 29/46* (2013.01); *B65H 5/06* (2013.01); *B65H 29/14* (2013.01); *B65H 29/22* (2013.01); *B65H 31/00* (2013.01); *B65H 2404/144* (2013.01); *B65H 2701/1914* (2013.01)

(58) Field of Classification Search

CPC ..... B65H 29/00; B65H 29/20; B65H 29/22; B65H 29/38; B65H 29/46; B65H 29/60; B65H 31/00; B65H 2402/31; B65H 2404/144; B65H 2404/1441; B65H 2701/1914

See application file for complete search history.

(56) References Cited

U.S. PATENT DOCUMENTS 2,595,346 A * 5/1952 Federwitz ..... B41L 47/18 271/180
3,870,166 A * 3/1975 Tull, III ..... B65B 13/10 414/790.3

(Continued)

FOREIGN PATENT DOCUMENTS

| | | | |
|---|---|---|---|
| GB | 1396138 | A | 6/1975 |
| JP | S61203063 | A | 9/1986 |
| JP | S63171760 | A | 7/1988 |

OTHER PUBLICATIONS

"European Application Serial No. 20154281.8, Extended European Search Report dated Jul. 27, 2020", 8 pgs.

*Primary Examiner* — Prasad V Gokhale
(74) *Attorney, Agent, or Firm* — Schwegman Lundberg & Woessner, P.A.

(57) ABSTRACT

A card stacker includes a stack support that supports a stack of card substrates, a card lift mechanism, a card feed mechanism, and a retraction mechanism. The card lift mechanism is configured to support the card substrate in a lift position below the stack support, and drive the card substrate to a raised position, in which the card substrate is supported on the stack support at the bottom of the stack. The card feed mechanism includes a first transport roller having a feed position, in which the first transport roller engages a top surface of the card substrate in the lift position, and a retracted position when the card substrate is in the raised position, in which the first transport roller is on the bottom side of the stack support. The retraction mechanism is configured to move the first transport roller between the feed and retracted positions.

20 Claims, 12 Drawing Sheets

(56) References Cited

U.S. PATENT DOCUMENTS

| | | | | |
|---|---|---|---|---|
| 4,432,685 | A * | 2/1984 | Stauber | B65H 31/30 414/788.3 |
| 4,560,293 | A | 12/1985 | McCumber et al. | |
| 5,415,519 | A * | 5/1995 | Lee | B65G 57/302 414/791.2 |
| 6,089,457 | A | 7/2000 | Lamanna et al. | |
| 6,199,857 | B1 * | 3/2001 | Lien | B65H 29/46 271/180 |
| 6,431,537 | B1 | 8/2002 | Meier | |
| 2012/0175836 | A1 * | 7/2012 | Meier | B65H 1/04 271/3.19 |
| 2017/0358166 | A1 | 12/2017 | Zaborowski et al. | |

* cited by examiner

CARD STACKER

FIELD

Embodiments of the present disclosure relate to a card stacker for stacking card substrates and, more specifically, to a card stacker that is configured to deliver card substrates to the bottom of a stack of card substrates.

BACKGROUND

Card products include, for example, credit cards, identification cards, driver's licenses, passports, and other card products. Such card products generally include printed information, such as a photo, account numbers, identification numbers, and other personal information. Credentials can also include data that is encoded in a smartcard chip, a magnetic stripe, or a barcode, for example.

Card production devices include processing devices that process card substrates to form the final card product. Such processes generally include a printing process, a laminating or transfer process, a data reading process, a data writing process, and/or other process used to form the desired credential. Credential production devices typically include a collection unit, such as a hopper or other container, for collecting the processed card products.

SUMMARY

Embodiments of the present disclosure are directed to a card stacker for use with a card production device, a card stacker assembly that includes a plurality of the card stackers, and methods of using the card stacker to add a card substrate to a bottom of a stack of card substrates. One embodiment of the card stacker is configured to deliver a card substrate to a bottom of a stack of card substrates and includes a stack support, a card lift mechanism, a card feed mechanism, and a retraction mechanism. The stack support is configured to hold the stack of card substrates on a top side of the stack support that is opposite a bottom side of the stack support. The card lift mechanism is configured to support the card substrate in a lowered position on the bottom side of the stack support, and drive the card substrate to a raised position, in which the card substrate is positioned at the bottom of the stack of card substrates and is supported by the top side of the stack support. The card feed mechanism includes a first transport roller having a feed position when the card substrate is in the lowered position, and a retracted position when the card substrate is in the raised position. The first transport roller engages a top surface of the card substrate that faces the bottom side of the stack support when in the feed position. The first transport roller is on the bottom side of the stack support when in the retracted position. The retraction mechanism is configured to move the first transport roller between the feed and retracted positions.

One embodiment of the card stacker assembly includes a plurality of card stackers, each card stacker configured to deliver a card substrate to a bottom of a stack of card substrates. Each of the card stackers includes a stack support, a card lift mechanism, and a card feed mechanism. The stack support includes a top side configured to hold the stack of card substrates. The card lift mechanism is configured to drive the card substrate from a lowered position on a bottom side of the stack support that is opposite the top side to a raised position, in which the card substrate is positioned at the bottom of the stack of card substrates and is supported by the top side of the stack support. The card feed mechanism includes first and second pinch roller pairs that are respectively configured to receive or discharge individual card substrates along a card path through first and second ports positioned on opposing sides of the card lift mechanism. The plurality of card stackers are positioned in a side-by-side arrangement. A card substrate discharged through the second port of one of the card stackers is received through the first port of an adjoining card stacker.

In one embodiment of a method of adding a card substrate to a bottom of a stack of card substrates supported on a top side of a stack support of a card stacker, the card substrate is received with a card feed mechanism of the card stacker. The card feed mechanism includes a transport roller. The card substrate is supported in a lowered position on a bottom side of the stack support, which includes engaging a top surface of the card substrate that faces the bottom side of the stack support with the transport roller in a feed position. The card substrate is raised from the lowered position to a raised position, in which the card substrate is positioned on the bottom of the stack of card substrates and is supported on the top side of the stack support using a card lift mechanism of the card stacker. The transport roller is moved from the feed position to a retracted position, in which the transport roller is positioned and on the bottom side of the stack support during the raising of the card substrate.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

DETAILED DESCRIPTION OF ILLUSTRATIVE EMBODIMENTS

Figure 1:
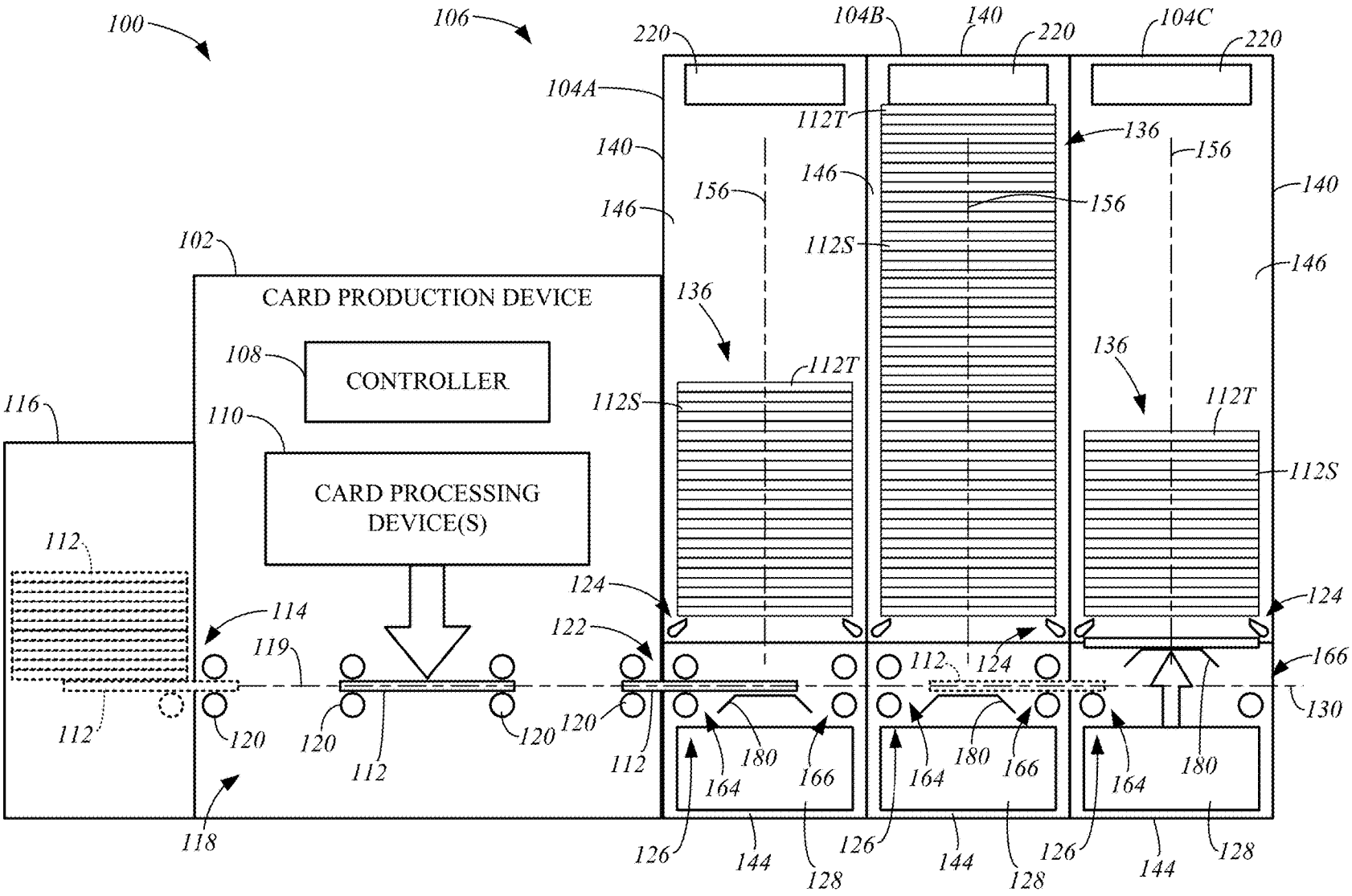
FIG. 1 is a simplified illustration of a card production system in accordance with embodiments of the present disclosure.

Embodiments of the present disclosure are directed to a card stacker that may be used with a card production device to deliver card substrates to a bottom of a stack of card substrates contained in the card stacker. In some embodiments, the card stacker is a modular device that may be combined with other card stackers to increase the card stacking capacity of the card production system.

These and other embodiments of the present disclosure are described more fully hereinafter with reference to the accompanying drawings. Elements that are identified using the same or similar reference characters refer to the same or similar elements. The various embodiments of the present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art.

FIG. 1 is a simplified illustration of a card production system 100 that includes a card production device 102 and one or more card stackers 104 formed in accordance with embodiments of the present disclosure. While the system 100 is shown as including a card stacker assembly 106 formed of three card stackers 104A-C, it is understood that embodiments of the present disclosure include systems 100 that include a single card stacker 104, or a card stacker assembly 106 comprising two or more card stackers 104.

The system 100 also includes a controller 108 and one or more card processing devices 110. The controller 108 represents one or more distinct controllers of the system 100 each including at least one processor that is configured to execute program instructions stored in a computer-readable media or memory of the device 100, which may also be represented by the controller 108, or another location. Any suitable patent subject matter eligible computer readable media or memory may be utilized including, for example, hard disks, CD-ROMs, optical storage devices, flash memory, magnetic storage devices, or other suitable computer readable media or memory. Such computer readable media or memory do not include transitory waves or signals. The execution of the instructions by the controller 108 controls components of the system 100 to perform functions and method steps described herein.

The one or more card processing devices 110 are each configured to perform a process on a card substrate 112. The card processing devices may include conventional card processing devices, such as a printing device configured to print an image to a surface of the card substrate 112 through a direct or transfer printing process, a laminating device configured to apply an overlaminate to a surface of the substrate 112, a data reading and/or writing device (e.g., a chip encoder, a magnetic stripe encoder, etc.) configured to read data from, and/or write data to, the substrate 112, a card flipper configured to invert the substrate 112, and/or another conventional card processing device.

In some embodiments, individual substrates 112 may be received at an input 114 by the card production device 110 from a card substrate supply 116, as shown in FIG. 1, or another device of the system 100. A transport mechanism 118 feeds individual substrates 112 along a processing path 119 to the one or more processing devices 110. The transport mechanism 118 may include conventional motorized feed rollers and pinch roller pairs 120, as shown in FIG. 1. The card stackers 104 may be positioned to receive individual card substrates 112 discharged through an output 122 of the card production device 102 by the transport mechanism 112, as shown in FIG. 1.

Figure 2:
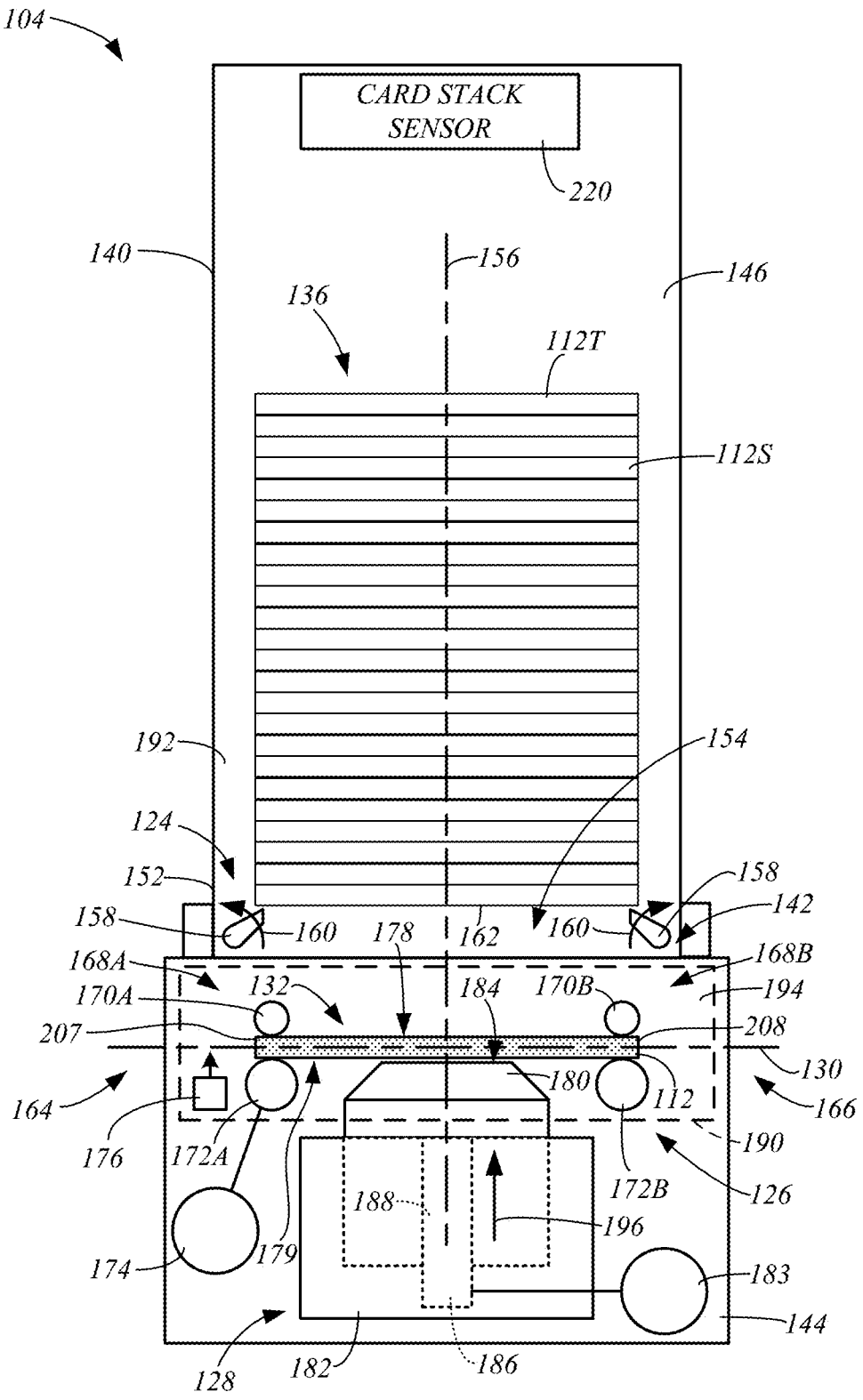
FIG. 2 is a simplified side view of an exemplary card stacker, in accordance with embodiments of the present disclosure.
Figure 3:
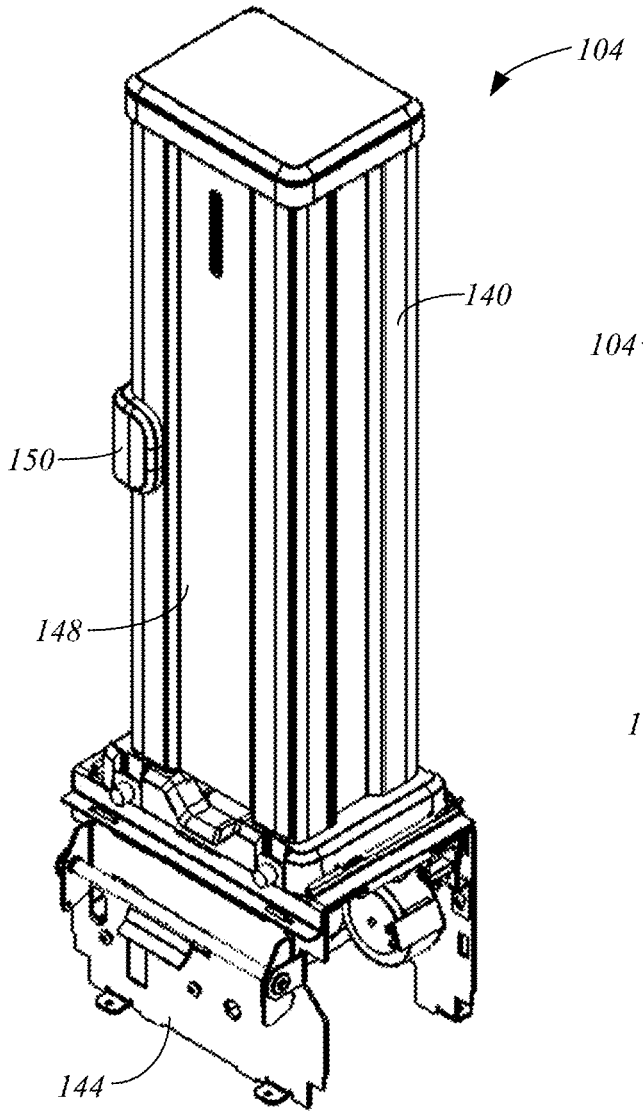
FIGS. 3 and 4 are isometric assembled and exploded views of an exemplary card stacker, in accordance with embodiments of the present disclosure.
Figure 4:
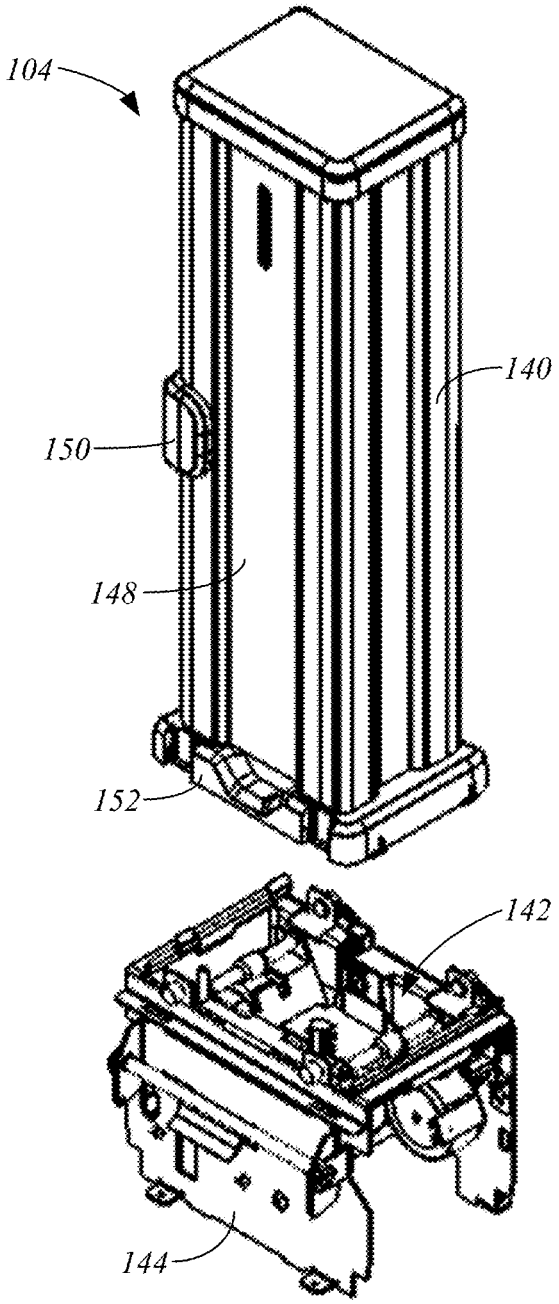

Embodiments of the card stacker 104 will be described with reference to the FIGS. 2-4. FIG. 2 is a simplified side view of an exemplary card stacker 104, and FIGS. 3 and 4 are isometric assembled and exploded views of an exemplary card stacker 104. As discussed in greater detail below, each of the card stackers 104 includes a stack support 124, a card feed mechanism 126, and a card lift mechanism 128, as shown in FIG. 2. The card feed mechanism 126 of each card stacker 104 is generally configured to feed individual card substrates 112 along a card feed path 130, which may be aligned with the processing path 119 (FIG. 1) of the card production device 102, to a lift position 132 within the card stacker 104 or to handoff the substrate to the next card stacker 104. Each lift mechanism 128 is configured to perform a lift operation on individual substrates 112 that are positioned in the lift position 132 within the card stacker 104. The lift operation, which is illustrated as being performed by the card lift mechanism 128 of the card stacker 104C, delivers the substrate 112 from the lift position 132 in the card feed path 130 to the bottom of a card stack 136 of substrates 112S supported on the stack support 124.

In some embodiments, each card stacker 104 includes a stack housing 140 that is removably supported within a receptacle 142 of a base 144, which includes the card lift mechanism 128 and the card feed mechanism 126. The stack housing 140 defines an interior cavity 146 that is configured to contain the card stack 136, as shown in FIG. 2. The housing 140 may include an access to the interior cavity 146, such as a hinged door 148 (FIGS. 3 and 4) or other suitable access, for removal of the card stack 136. The door 148 may be locked using a suitable locking mechanism 150.

The stack support 124 is supported at a bottom 152 of the stack housing 140 adjacent an opening 154 in the housing 140, and is configured to support the substrate stack 136 in a vertical column within the interior cavity 146 that is generally aligned with an axis 156. During a substrate lifting operation, a substrate 112 is delivered through the opening 154 in the bottom 152 of the housing 140 adjacent the stack support 124 to the bottom of the substrate stack 136 and on the stack support 124.

The stack support 124 may take on any suitable form. In one example, the stack support 124 includes multiple catch pawls 158 that may be pivoted in the direction indicated by arrows 160 (FIG. 2) during a lift operation, but are restricted from pivoting in the direction opposite the arrows 160 past a support position, which is shown in FIG. 2. The stack support 124 may include, for example, three or four catch pawls 158 that support the bottom surface 162 of the bottom substrate 112S of the stack 136 in a substantially perpendicular orientation to the axis 156, as shown in FIG. 2.

Each card feed mechanism 126 is configured to receive substrates 112 through a port 164, feed the individual substrates 112 along the card feed path 130 to the lift position 132, in which the substrate 112 is positioned for a lifting operation using the corresponding lift mechanism 128, or deliver the substrates to an adjoining card stacker 104 through a port 166 on the opposing side of the axis 156 from the port 164. For example, with reference to FIG. 1, the card feed mechanism 126 of the card stacker 104A is configured to receive individual card substrates 112 discharged through the output 122 of the card production device 102 at the port 164 and feed the substrate 112 along the card feed path 130 to the lifting position 132, in which the lift mechanism 128 may perform a lift operation, or discharge the substrate 112 through the port 166 where it is received by the card feed mechanism 126 of the card stacker 104B through the port 164. Likewise, the card feed mechanism 126 of the card stacker 104B may feed the substrate 112 received from the card stacker 104A to position it for a lift operation or handoff the substrate 112 to the card feed mechanism 126 of the card stacker 104C, such as indicated by the substrate 112 drawn in phantom lines. The card stacker 104C, which is the last card stacker of the assembly 106 in the exemplary system 100 of FIG. 1, may use its card feed mechanism 126 to position the card substrate 112 for a lift operation using its lift mechanism 128 to deliver the substrate 112 to the bottom of the card stack 136 supported by the stack support 124, as indicated in FIG. 1, or discharge the card substrate 112 through the port 166, for example.

The card feed mechanism 126 of each card stacker 104 can take on any suitable form. In some embodiments, the card feed mechanism 126 includes pinch roller pairs 168, such as pinch roller pairs 168A and 168B, which are respectively positioned on opposing sides of the axis 156 adjacent the ports 164 and 166. Each of the pinch roller pairs 168 include upper and lower transport rollers 170 and 172, respectively, such as upper transport rollers 170A and 170B, and lower transport rollers 172A and 172B. While the card feed mechanism 126 is illustrated as having two pinch roller pairs 168A and 168B, embodiments of the present disclosure include the use of the single pinch roller pair or other configurations.

The pinch roller pairs 168 are configured to drive a received substrate 112 along the card feed path 130 when in a feed position, such as shown in FIG. 2. When in the feed position, one or both of the pinch roller pairs 168A and 168B pinch a received substrate 112 between the upper and lower transport rollers 170 and 172 and support the substrate 112 in substantial alignment with the card feed path 130.

A motor 174 is configured to drive the pinch roller pairs 168, such as through a conventional mechanical linkage, to feed a received card substrate 112 along the card feed path 130. In some embodiments, the motor 174 is configured to drive the lower transport rollers 172, and the upper transport rollers 170 are idler motors that are not directly driven by the motor 174.

In some embodiments, the card feed mechanism 126 includes a card sensor 176 that is configured to detect reception of a card substrate 112 fed along the card feed path 130, such as from the card production device 102 or an adjoining card stacker 104, for example. In some embodiments, the card sensor 176 is used to detect a leading or trailing edge of the substrate 112 to establish a position of the substrate 112 relative to the card feed mechanism 126 along the card feed path 130. This allows the controller 108 to control the card feed mechanism 126 to position the substrate 112 in the lift position 132 along the card feed path 130, or handoff the substrate 112 to an adjoining card stacker 104. In some embodiments, the motor 174 is a stepper motor, and the detection of the leading or trailing edge of the substrate 112 using the card sensor 176 allows the controller 108 to position the substrate 112 in a desired location along the card feed path 130 relative to the card feed mechanism 126 by driving the motor 174 a predetermined number of steps.

As discussed above, the card feed mechanism 126 is configured to position a received substrate 112 in a lift position 132 (FIG. 2) along the card feed path 130 for a lifting operation. In some embodiments, the pinch roller pairs 168A and 168B simultaneously support the substrate 112 when it is in the lift position 132. Thus, in some embodiments, the upper transport rollers 170 of the pinch roller pairs 168A and 168B each engage a top surface 178 of the card substrate 112 when it is in the lift position 132, and the bottom transport rollers 154 each engage a bottom surface 179 of the substrate 112 when it is in the lift position 132.

Some embodiments of the lift mechanism 126 include a card support member 180 and a drive mechanism 182, which is driven by a motor 183 (FIG. 2), such as through a conventional mechanical linkage. The card support member 180 has a lowered position, shown in FIG. 2, that corresponds to the feed position of the pinch roller pairs 168A and 168B and the lift or lowered position 132 of the card substrate 112, in which the substrate 112 is aligned with the card feed path 130, as shown in FIG. 2. In some embodiments, the card support member 180 includes a top surface 184 that can support the substrate 112 as it is fed along the card feed path 130. For example, when a card substrate 112 is received by the pinch roller pair 168A, the leading edge of the substrate 112 may be supported by the top surface 184 of the card support member 180 as the leading edge of the card substrate 112 as it is fed to the pinch roller pair 168B.

During a lift operation, the lift mechanism 128 delivers a card substrate 112 supported on the card support member 180 from the lift position 132 (FIG. 2) along the axis 156 through the opening 154 of the stack housing 140 to the bottom of the card stack 136 using the drive mechanism 182, as generally illustrated by the card stacker 104C in FIG. 1. The drive mechanism 182 may take on any suitable form. In some embodiments, the drive mechanism 182 includes a threaded rod 186 that is received within a threaded bore 188 of the card support member 180, as indicated in FIG. 2. The rod 186 may be substantially coaxial to the axis 156. The motor 183 drives rotation of the rod 186 about the axis 156, and the threaded engagement with the card support member 180 drives the card support member 180 along the axis 156 either toward or away from the card stack 136.

When the card substrate 112 is in the lift position 132 within a card stacker 104, one or more components of the card feed mechanism 126 block the desired lifting path of the substrate 112 to the bottom of the card stack 136. For example, when the substrate 112 is supported between the pinch roller pairs 168A and 168B, and the upper transport rollers 170 engage the top surface 178 of the substrate 112. As a result, the position of the upper transport rollers 170 between the substrate 112 and the opening 154 to the housing 140 prevent the delivery of the substrate 112 to the bottom of the card stack 136.

In some embodiments, each card stacker 104 includes a retraction mechanism, which is generally indicated by box 190 in FIG. 2. The retraction mechanism 190 is configured to facilitate a lift or stacking operation by clearing the one or more components of the card feed mechanism 126 from the desired lifting path for substrate 112, which allows the lift mechanism 128 to deliver the substrate 112 to the bottom of the card stack 136 supported on the stack support 124. In some embodiments, the retraction mechanism 190 is configured to move the upper transport rollers 170A and 170B of the pinch roller pairs 168A and 168B from the lifting path of the card substrate 112 to facilitate a lifting operation.

Exemplary embodiments of the retraction mechanism 190 will be described along with an exemplary lift or stacking operation with reference to FIGS. 2 and 5-9, which are each simplified side views of an exemplary card stacker 104 during various stages of the lift or stacking operation. Initially, with the pinch roller pairs 168A and 168B in the feed position and the lift mechanism 128 in its lowered position, the substrate 112 is fed along the card feed path 130 to the lift position 132 shown in FIG. 2. Here, the card stack 136 is supported on a top side 192 of the stack support 124, and the substrate 112, the pinch roller pairs 168A and 168B and the top surface 184 of the card support member 180 are each positioned on a bottom side 194 of the stack support 124, as shown in FIG. 2. Thus, as used herein, the terms "top" and "bottom" refer to relative positions along the axis 156, in which the top side or position is located along the axis 156 in an upward direction, which is indicated by arrow 196, from the bottom side or position.

With the substrate 112 supported in the lift position 132 (FIG. 2), the lift mechanism 128 raises the card support member 180 using the drive mechanism 182 in the upward direction 196. In some embodiments, the retraction mechanism 190 moves the upper transport rollers 170 from their feed position, which is indicated in phantom lines, away from the axis 156 as indicated by arrows 198. This movement of the upper transport rollers 170 may also involve an upward movement of the upper transport rollers 170 from their feed positions along the axis 156. In some embodiments, this movement of the upper transport rollers 170 by the retraction mechanism 190 is driven in response to the upward movement of the card support member 180 by the lift mechanism 128. Thus, in some embodiments, the retraction mechanism 190 is driven by the drive mechanism 182 of the lift mechanism 128 using the motor 183.

Figure 5:
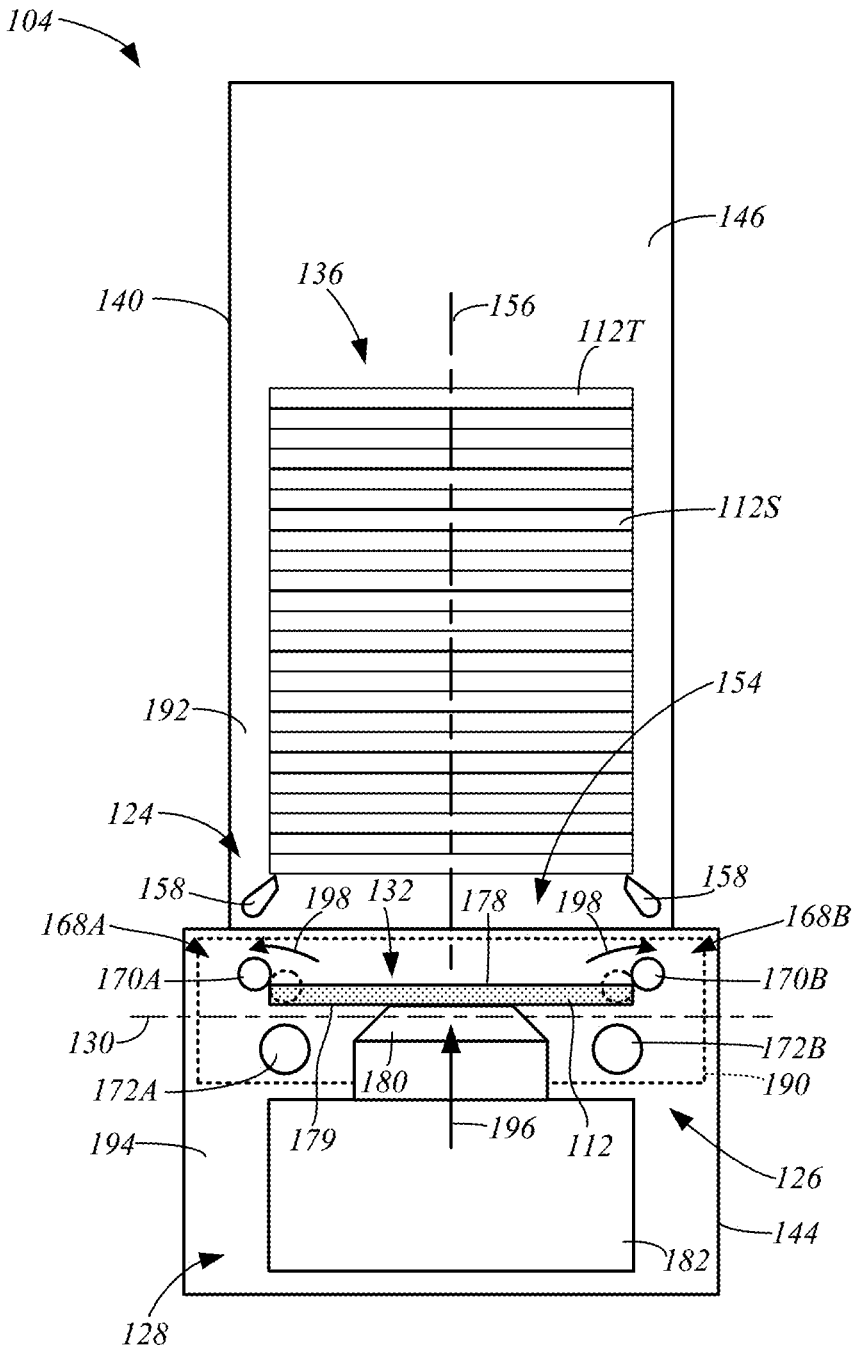
FIGS. 5-9 are simplified side views of an exemplary card stacker during various stages of the lift or stacking operation, in accordance with embodiments of the present disclosure.

Following this initial movement of the upper transport rollers 170 from their feed positions, the upper transport rollers 170 reach a position in which they remain engaged with the card substrate 112, such as the top surface 178 or the side edges of the substrate 112, as shown in FIG. 5. As a result, the upper transport rollers 170 continue to hold the substrate 112 in the lift position 132 relative to the axis 156 following this initial raising of the substrate 112 toward the card stack 136.

Figure 6:
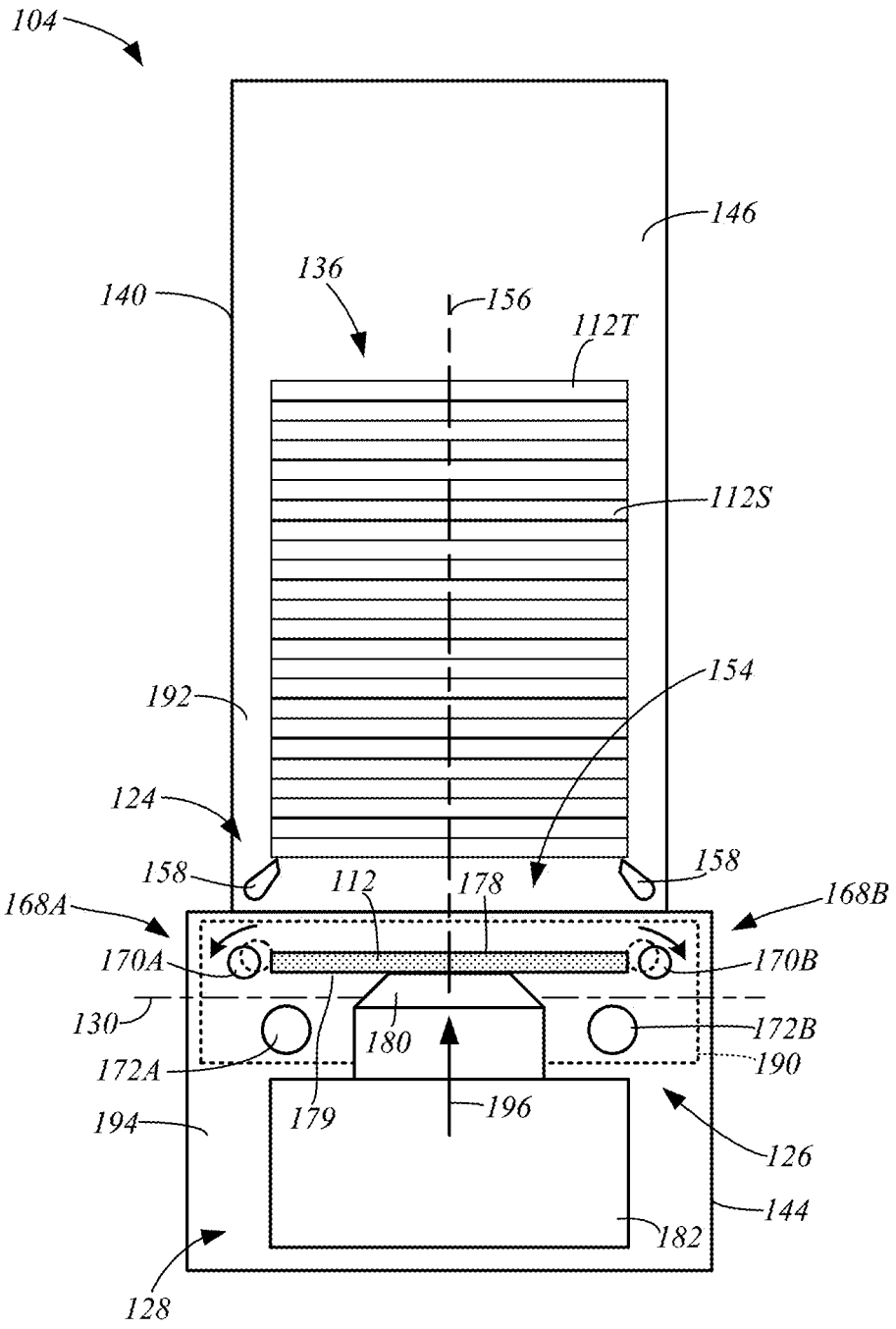
Figure 7:
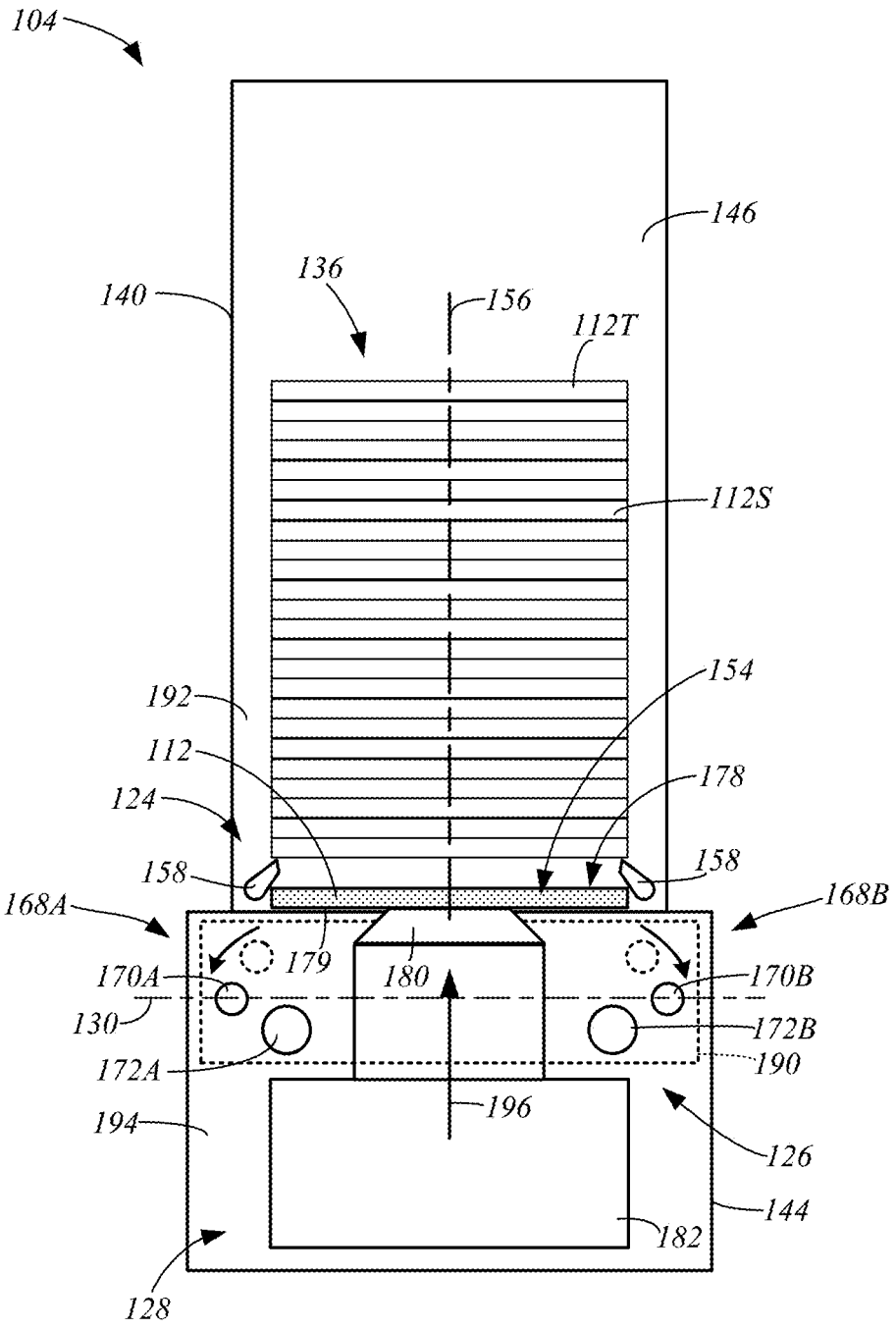

As the lift mechanism 128 continues to raise the substrate 112 along the axis 156, the upper transport rollers 170 continue to be moved further from the axis 156 from their position in FIG. 5 (shown in phantom lines) by the retraction mechanism 190 until they are outside a projection of the substrate 112 along the axis 156, as shown in FIG. 6. Further movement of the upper transport rollers from their position in FIG. 6 (shown in phantom lines) allows the lift mechanism 128 to continue to deliver the substrate 112 along the axis 156 toward the opening 154 in the stack housing 140 to the stack support 124 (e.g., catch pawls 158), as shown in FIG. 7. Thus, the retraction mechanism 190 moves the upper transport rollers 170 from their feed position (FIG. 2), in which the upper transport rollers 170 engage the top surface 178 of the substrate 112, to a retracted position (FIG. 6), in which the upper transport rollers 170 are displaced from the lifting path of the substrate 112 and are positioned below the substrate 112, in response to the raising of the substrate 112 by the lift mechanism 128.

Figure 8:
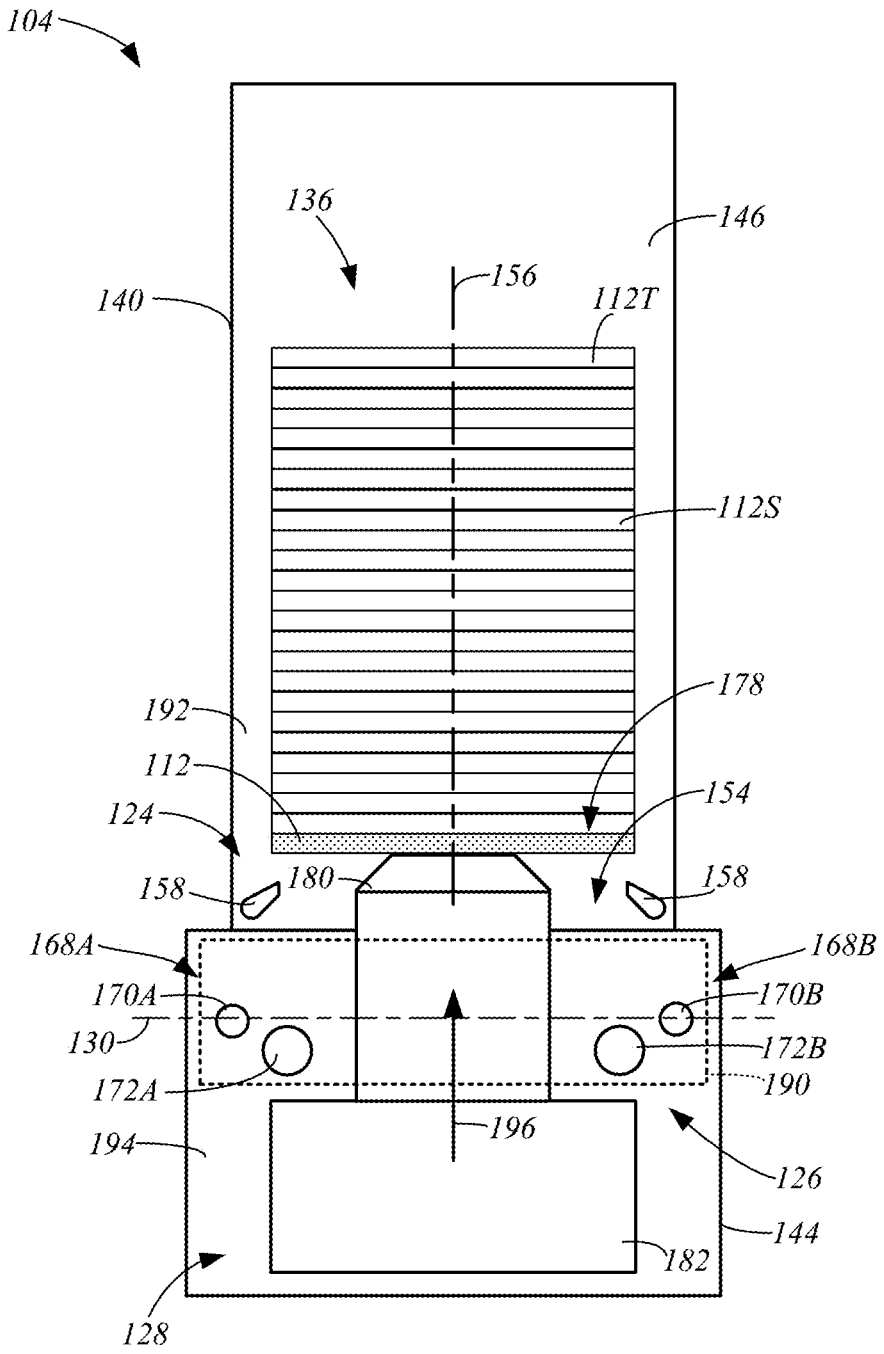

Next, the card support member 180 is driven by the drive mechanism 182 to raise the substrate 112 along the axis 156 to the top side 192 of the stack support 124 and in engagement with the bottom of the stack 136, as shown in FIG. 8. For example, the drive mechanism 182 delivers the substrate 112 through the catch pawls 158, which rotate in the direction 160 (FIG. 2), and in engagement with the bottom substrate 112S of the stack 136. This positions the substrate 112 on the top side 192 of the stack support 124.

Figure 9:
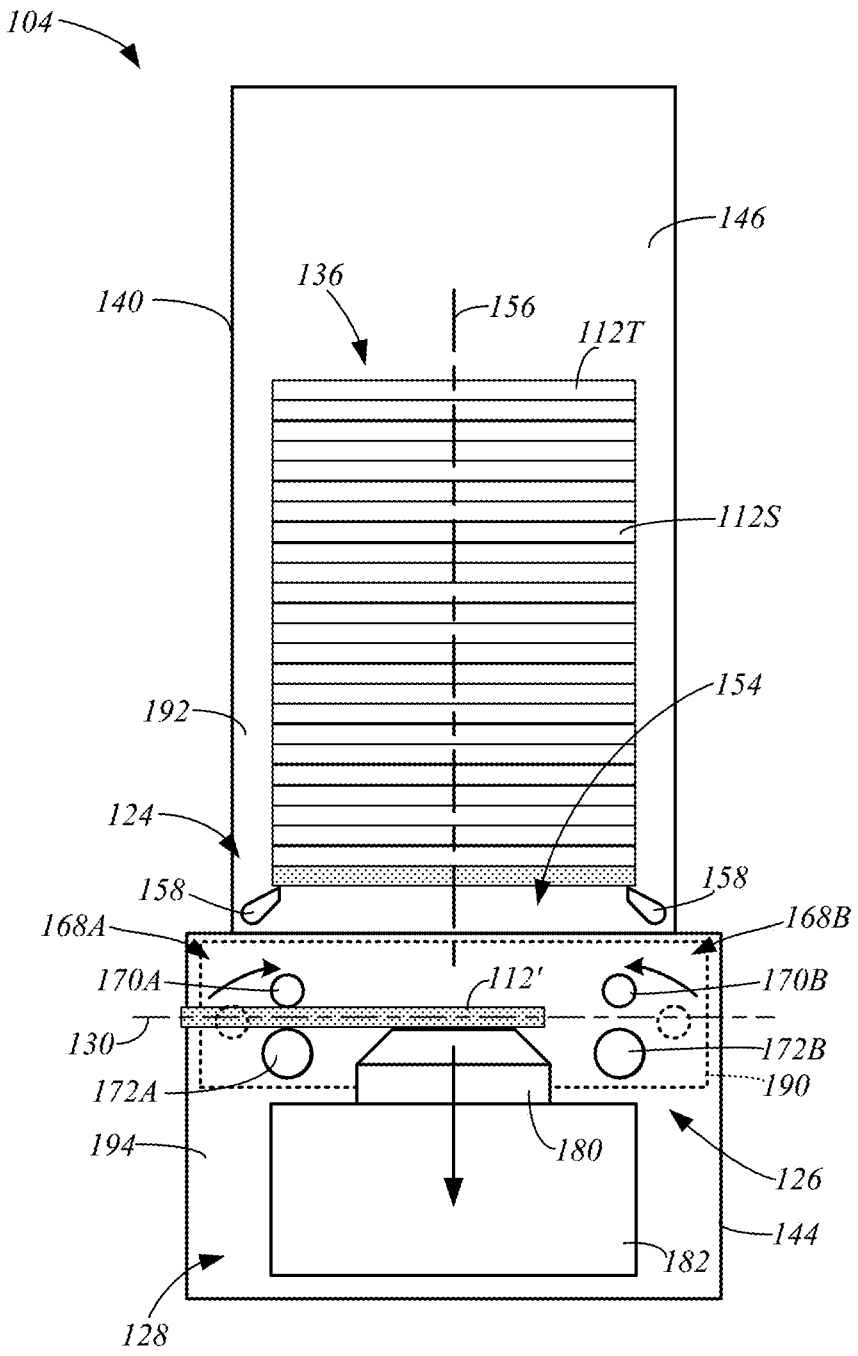

The card support member 180 is then lowered along the axis 156 by the drive mechanism 182 to the lowered position, as shown in FIG. 9. The catch pawls 158 rotate in the direction opposite the arrows 160 (FIG. 2) to their support position, in which they support the substrate 112 and the rest of the card stack 136. Additionally, during the lowering of the card support member 180, the retraction mechanism 190 pivots the upper transport rollers 170A and 170B of the pinch roller pairs 168A and 168B from their retracted position (shown in phantom lines) to their feed position, as indicated by the arrows in FIG. 9, to complete the card stacking operation. Thus, the card feed mechanism 126 and the lift mechanism 128 are positioned to receive a new substrate 112' fed along the card feed path 130, as indicated in FIG. 9.

Figure 10:
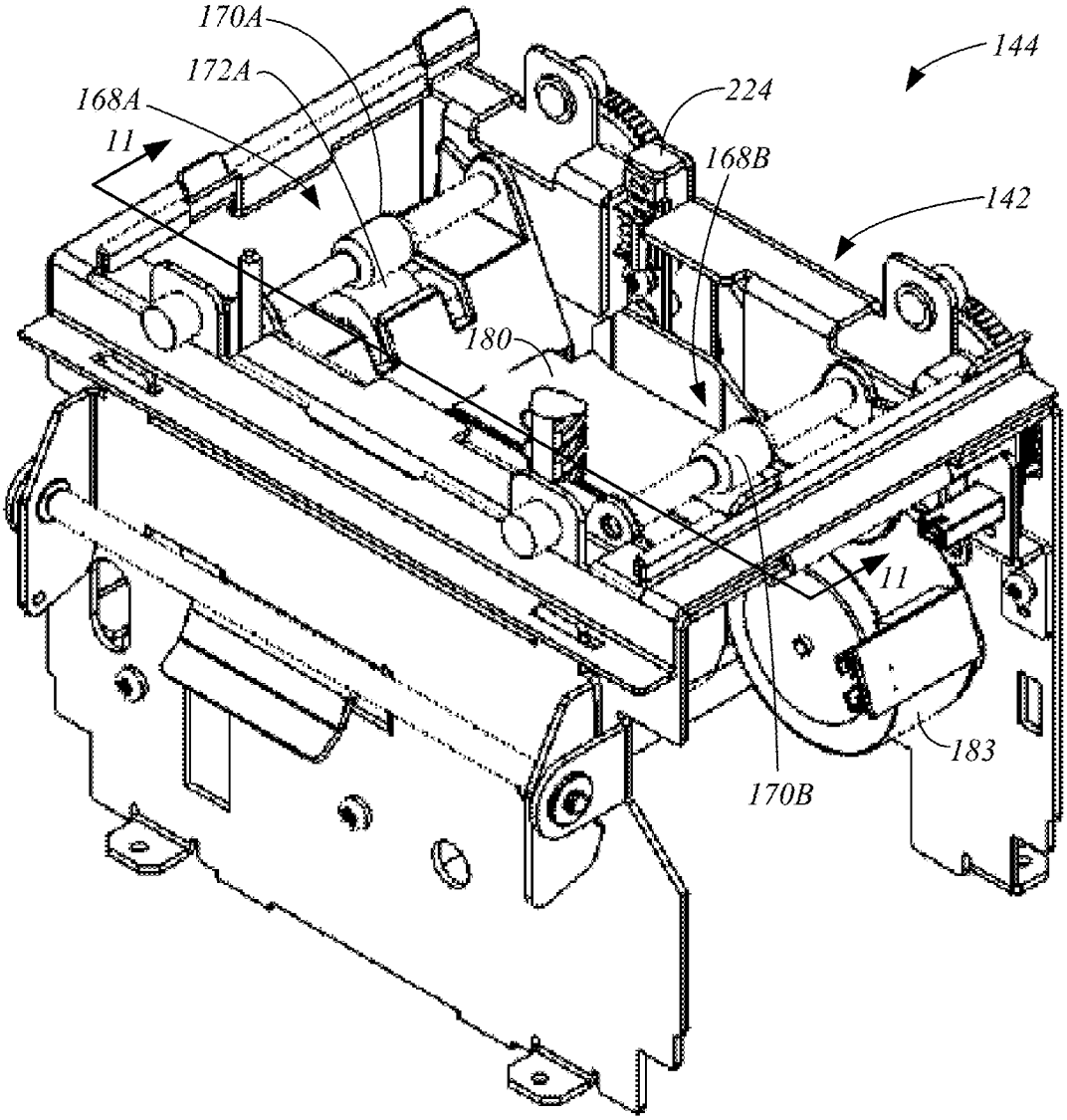
FIG. 10 is an isometric view of an exemplary base of a card stacker, in accordance with embodiments of the present disclosure.

The retraction mechanism 190 can take on any suitable form while driving movement of the upper transport rollers 170 from their feed position (FIG. 2) to their retracted position (e.g., FIG. 8). Exemplary embodiments of the retraction mechanism 190 will be described with reference to FIGS. 10-14. FIG. 10 is an isometric view of an exemplary base 144 of a card stacker 104, in accordance with embodiments of the present disclosure. FIGS. 11-14 are side cross-sectional views of the base 144 of FIG. 10 taken generally along line 11-11, during various stages of a substrate lifting or stacking operation. The upper transport roller 170A and the bottom transport roller 172A are shown in phantom lines in order to show features of the retraction mechanism 190.

In some embodiments, the retraction mechanism 190 includes pivotable supports 200A and 200B, which are respectively attached to the card support member 180 through suitable pivotable connections 202A and 202B, such as hinges, for example. The pivotable connections 202A and 202B allow the supports 200A and 200B to respectively pivot about axes 204A and 204B, which are generally perpendicular to the direction the substrates 112 are fed along the card feed path and the axis 156. The upper transport roller 170A is connected to the support 200A and the upper roller 170B is connected to the support 200B. Thus, the transport rollers 170A and 170B move with movement of the corresponding support 200A and 200B. In some embodiments, the transport rollers 170A and 170B have a fixed position relative to the corresponding support 200A and 200B.

The support 200A may be biased to pivot about the axis 204A in the direction indicated by arrow 206A, and the support 200B may be biased to pivot about the axis 204B in the direction indicated by arrow 206B. In some embodiments, this biasing of the supports 200A and 200B is facilitated using conventional techniques, such as a coil spring or another suitable biasing mechanism. The biasing of the supports 200A and 200B about the corresponding axes 204A and 204B, also biases the upper transport rollers 170A and 170B in the same manner. As a result, when the pinch rollers 168A and 168B are in their feed position (FIGS. 2 and 11), the upper transport rollers 170A and 170B are generally biased toward the top surface 178 of the card substrate 112 and pinch the card substrate 112 against the corresponding lower transport rollers 172A and 172B, which engage the bottom surface 179 of the card substrate 112. In some embodiments, the pinch roller pair 168A is configured to pinch the card substrate 112 in the lift position 132 adjacent a first edge 207 of the card substrate 112, and the pinch roller pair 168B is configured to pinch the substrate 112 in the lift position 132 adjacent a second edge 208 of the substrate 112 that is opposite the first edge 207, as best shown in FIG. 2.

As discussed above, in some embodiments, the movement of the transport rollers 170A and 170B from the feed position to the retracted position is driven in response to movement of the card support member 180 from the lowered position (FIG. 2) to the raised position (FIG. 8) during a substrate lifting or stacking operation. In some embodiments, the movement of the card support member 180 from the lowered position to the raised position drives each of the supports 200A and 200B to respectively pivot about the axes 204A and 204B, and transitions the transport rollers 170A and 170B from the feed position (FIG. 2) to the retracted position (FIG. 8). This can be accomplished using any suitable technique.

In one exemplary embodiment, the transport rollers 170A and 170B are driven from the feed position to the retracted position through engagement between the supports 200A and 200B and the bottom transport rollers 172A and 172B. For example, the supports 200A and 200B may respectively include a slot 210A and 210B through which shafts 212 of the corresponding bottom rollers 172A extend. In some embodiments, the shafts 212 are supported by a frame 200 of the base 144 and have a fixed position relative to the frame 200. As a result, the card support member 180, the supports 200A and 200B, and the transport rollers 170A and 170B move relative to the shafts 212 during movement of the card support member 180 along the axis 156. Accordingly, as the card support member 180 moves along the axis 156 during a substrate lifting or stacking operation, the shafts 212 slide within the slots 210A and 210B relative to the supports 200A and 200B. The slots 210A and 210B are shaped to pivot the supports 200A and 200B and drive the transport rollers 170A and 170B from the feed position to the retracted position along a desired path in response to the relative movement between the shafts 212 and the supports 200A and 200B.

Figure 11:
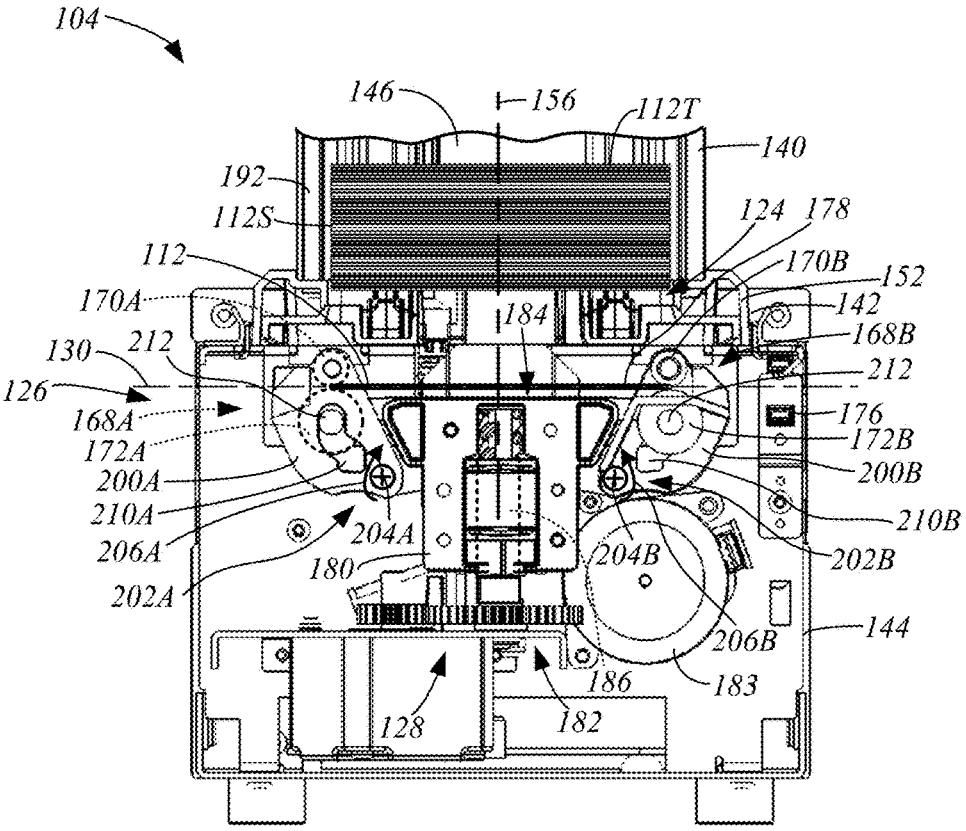
FIGS. 11-14 are side cross-sectional views of the base of FIG. 9 taken generally along line 10-10, during various stages of a substrate lifting or stacking operation.
Figure 12:
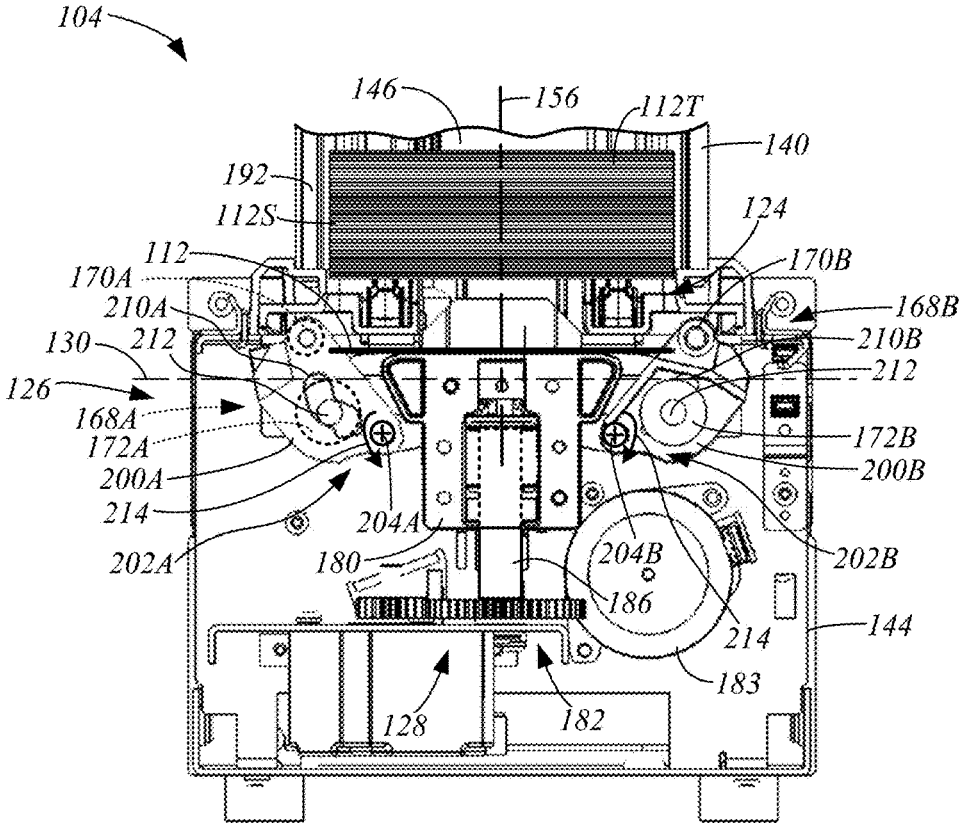

When the card support member 180 of the lift mechanism 128 is in its lowered position and the transport rollers 170A and 170B are in their feed position, a card substrate 112 may be fed along the card feed path 130 to the lift position 132, as shown in FIGS. 2 and 11. When in this position, the upper transport rollers 170A and 170B are biased toward the top surface 178 of the substrate 112 and pinch the substrate 112 against the bottom rollers 172A and 172B. At the beginning of the lifting operation, the card support member 180 engages the bottom surface 179 of the substrate 112 as the card support member 180 is raised from its lowered position along the axis 156, as shown in FIGS. 5 and 12. During this initial movement of the card support member 180, the upper transport rollers 170A and 170B are displaced from the corresponding bottom rollers 172A and 172B and may be rotated slightly about the corresponding axes 204A and 204B away from the central axis 156 in response to the engagement between the shafts 212 and the corresponding slots 210A and 210B, as shown in FIGS. 6 and 12.

Figure 13:
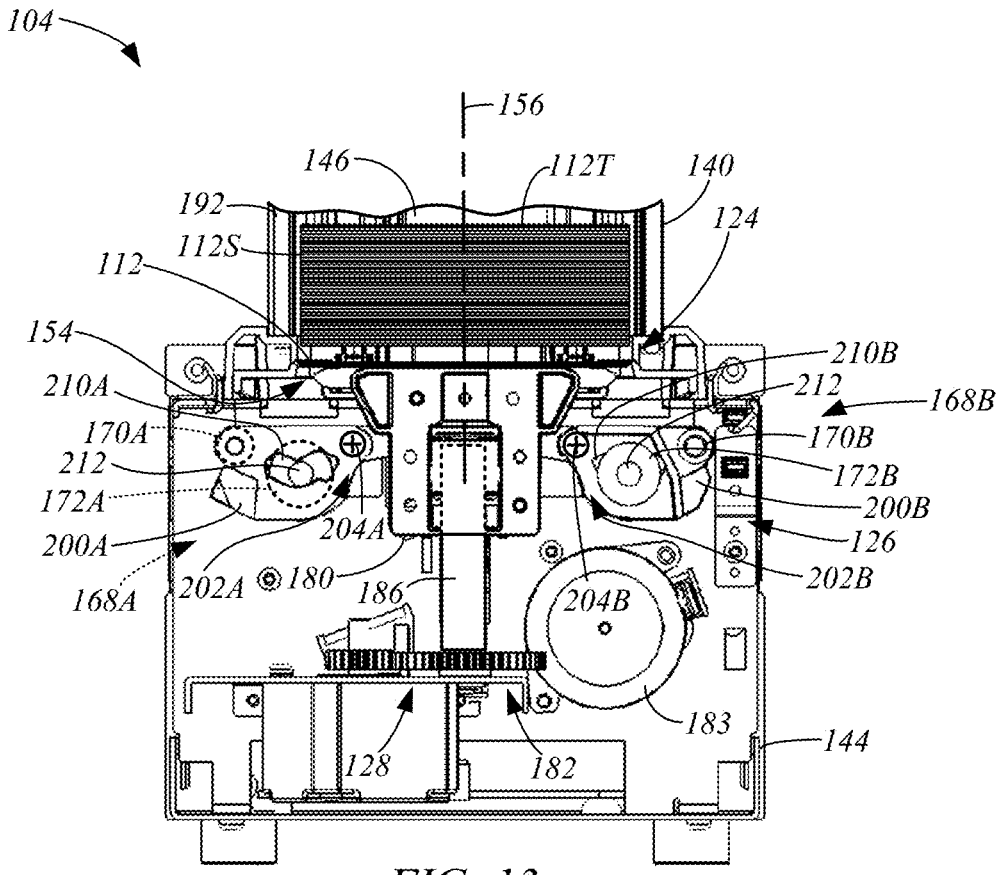
Figure 14:
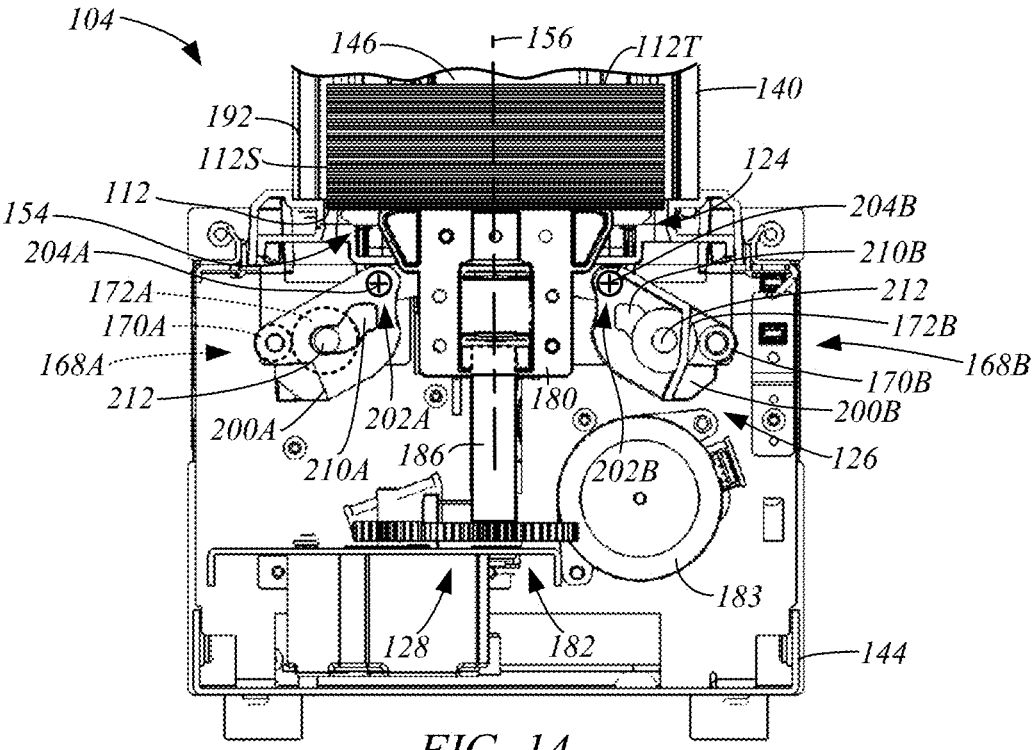

As the card support member 180 continues to raise the substrate along the axis 156 toward the raised position, the supports 200A and 200B and the attached transport rollers 170A and 170B are driven to pivot about the corresponding axes 204A and 204B in response to the engagement between the shafts 212 and the slots 210A and 210B in the direction indicated by arrows 214 in FIG. 12, to the retracted positions shown in FIGS. 13 and 14. FIG. 13 illustrates the card support member 180 driving the substrate 112 through the opening 154 in the bottom of the stack housing 140, and FIG. 14 illustrates the card support member 180 positioning the substrate 112 in the fully raised position, in which the substrate 112 is positioned on the top side 192 of the stack support 124, which is also shown in FIG. 8. The retracted positions (e.g., FIGS. 8 and 14) of the upper transport rollers 170A and 170B position the rollers 170A and 170B on the bottom side 194 of the stack support 124 and outside of the lifting path of the substrate corresponding to a projection of the substrate 112 along the axis 156.

The card support member 180 is then lowered along the axis 156 through the opening 154 in the housing 140 and back to its lowered position shown in FIGS. 2 and 11 using the lift mechanism 128. This movement of the card support member 180 pivots the supports 200A and 200B about the axes 204A and 204B and drives the upper transport rollers from the retracted position (FIGS. 8 and 14) to the feed position (FIGS. 2 and 11), to prepare the base 144 for receiving another card substrate 112.

In some embodiments, the card stacker 104 includes a card stack sensor 220 (FIGS. 1 and 2) that is configured to detect when the stack housing reaches a full condition, such as illustrated by card stacker 104B in FIG. 1, in which it no longer accepts additional substrates in the card stack 136. In some embodiments, the card stack sensor 220 is configured to detect a position of the top substrate 112T in the stack 136 that indicates the full condition. This may be accomplished using any suitable sensor arrangement.

Figure 15:
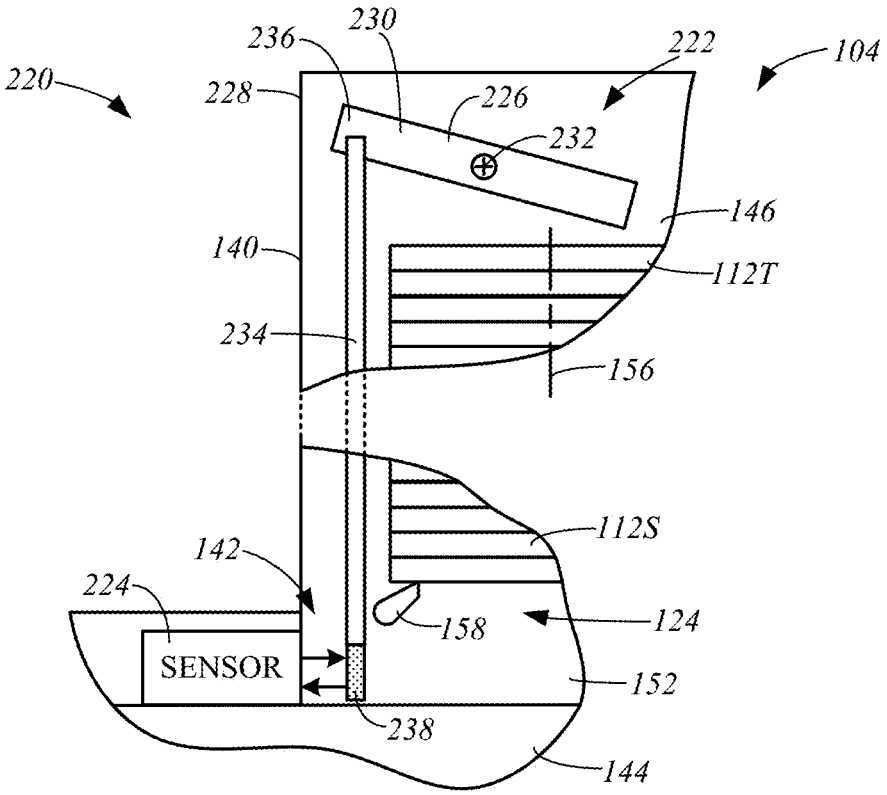
FIGS. 15 and 16 are simplified partial side views of a card stacker 104 in accordance with embodiments of the present disclosure.
Figure 16:
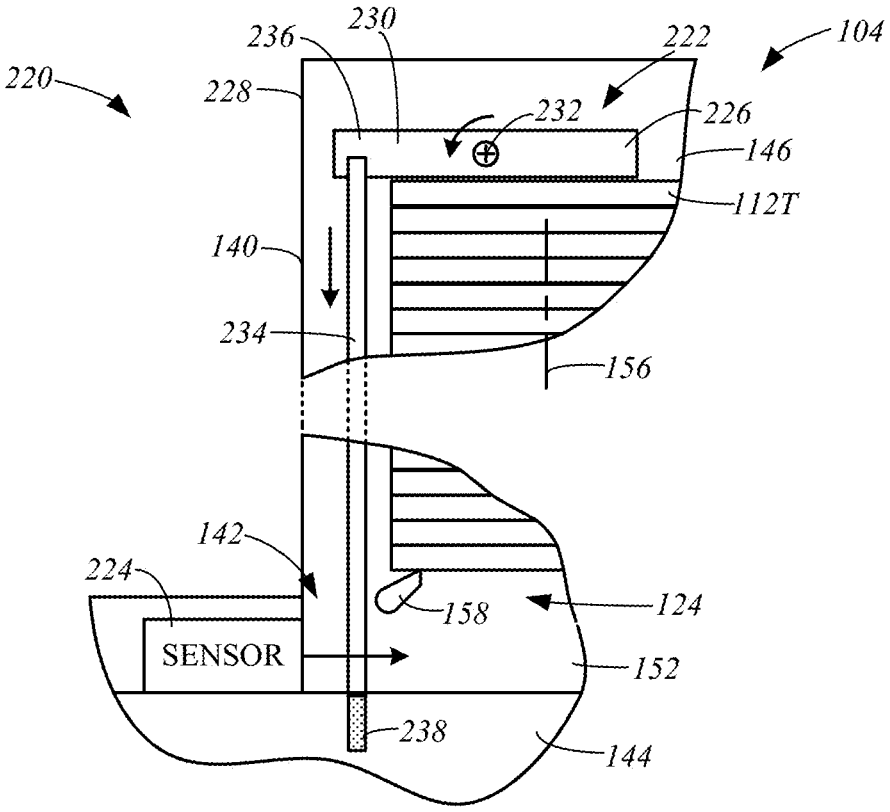

In some embodiments, the card stack sensor 220 includes a passive or mechanical sensing element 222 in the stack housing 140 and an active or electronic sensor 224 in the base 144, as shown in FIGS. 15 and 16, which are simplified partial side views of a card stacker 104 in accordance with embodiments of the present disclosure. This allows the card stacker 104 to provide the desired full stack sensing feature without electrical connections between the stack housing 140 and the base 144.

In some embodiment, the passive sensing element 222 includes a mechanical switch 226 positioned at the top end 228 of the interior cavity 146 of the stack housing 140. The active sensor 224 may be any suitable active sensor, such as an optical or capacitive sensor, that is supported in the base 144 adjacent the receptacle 142 that receives the bottom 152 of the housing 140. Before the stack 136 reaches a full condition, the top substrate 112T in the stack 136 does not trigger the mechanical switch 226, as shown in FIG. 15. However, as substrates 112 are added to the bottom of the stack 136, the top substrate 112T rises relative to the mechanical switch 226 and transitions the switch 226 from the first (not full) position (FIG. 15), to a second position indicating a full condition, as shown in FIG. 16.

The mechanical switch 226 may take on any suitable form. For example, the mechanical switch 226 may comprise a lever arm 230 that is configured to pivot about an axis 232 from the first position to the second position in response to the rising stack of substrates 126. A rod 234 is attached to an end 236 of the lever arm 230 and generally moves along the axis 156 in response to movement of the lever arm 230 from the first position to the second position. An end 238 of the rod 234 may initially be positioned for detection by the active sensor 224 when the lever arm 230 is in the first position, as shown in FIG. 15. When the lever arm 230 transitions to the second position, the end 238 of the rod 234 is lowered and moved out of the detection zone of the active sensor 224. This lack of detection of the end 238 of the rod 234 by the active sensor 224 may be used by the controller 108 to detect the full condition of the substrate stack 136. Alternatively, the mechanical switch 226 may be arranged to position the end 238 outside the detection zone of the active sensor 224 when the card stack 136 has not reached the full condition, and position the end 238 within the detection zone of the active sensor 224 when the card stack 136 has reached the full condition. Other card stack sensing arrangements may also be used to provide the desired detection of the full card stack condition within the stack housing 140.

In some embodiments, the active sensor 224 may also be used to detect whether the stack housing 140 is properly installed on the base 144. For instance, when the stack housing 140 is properly installed on the base 144 and the card stack 136 is not full, the lever arm 230 is in the first position and the end 238 of the rod 234 is positioned within the detection zone of the active sensor 224, as shown in FIG. 15. However, if the housing 140 is not properly seated within the receptacle 142 of the base 144, the active sensor 224 will not detect the end 238 of the rod 234. Thus, the controller 108 can use the detection of the end 238 of the rod 234 by the active sensor 224 to determine that the stack housing 140 is properly installed within the receptacle 142 of the base 144.

Thus, the controller 108 may enable substrate lifting or stacking operations to be performed by the card stacker 104, when the active sensor 224 detects the end 238 of the rod 234, and disable substrate lifting or stacking operations when the active sensor 224 does not detect the end 238 of the rod 234, as this may indicate that the stack housing 140 is either not installed on the base 144, is improperly installed on the base 144, or the card stack 136 has reached a full condition. However, the controller 108 may still use the base 144 to receive and pass substrates 112 to an adjoining card stacker 104 when card lifting or stacking operations are disabled. This is generally illustrated in FIG. 1, in which card stacker 104B has reached a full condition, but is able to pass a substrate 112 (shown in phantom lines) to the card stacker 104C.

In accordance with the above discussion, embodiments of the present disclosure include a card stacker 104 that is configured to deliver a card substrate 112 to a bottom of a stack 136 of card substrates 112S. In some embodiments, the card stacker 104 includes a stack support 124, a card feed mechanism 126, a card lift mechanism 128, and a retraction mechanism 190, as shown in FIG. 2. The stack support 124 is configured to hold the stack 136 of card substrates 112 on a top side 192 of the stack support 124 that is opposite a bottom side 194 of the stack support 124. The card lift mechanism 128 is configured to support the card substrate 112 in a lowered position (FIG. 2) on the bottom side 194 of the stack support 124, and drive the card substrate 112 to a raised position (FIG. 8), in which the card substrate 112 is positioned at the bottom of the stack of card substrates 126 and is supported on the top side 192 of the stack support 124.

Embodiments of the card feed mechanism 126 include an upper transport roller 170A having a feed position (FIG. 2) when the card substrate 112 is in the lowered position, and a retracted position (FIG. 8) when the card substrate 112 is in the raised position. The upper transport roller 170A engages a top surface 178 of the card substrate 112 that faces the bottom side 194 of the stack support 124 when in the feed position (FIG. 2). The upper transport roller 170A is positioned on the bottom side 194 of the stack support 124 when in the retracted position (FIG. 8). The retraction mechanism 190 is configured to move the upper transport roller 170A between the feed and retracted positions, as discussed above with reference to FIGS. 4-9 and 11-14.

In some embodiments, the card lift mechanism 128 includes a card support member 180 and a drive mechanism 182. The drive mechanism 182 is driven by a motor 183 and drives the card support member 180 between a lowered position (FIGS. 2 and 11) corresponding to the lowered position of the card substrate 112, and a raised position (FIGS. 8 and 14) corresponding to the raised position of the card substrate 112.

In some embodiments, the retraction mechanism 190 includes a first pivotable support 200A that is attached to the card support member 180 and is configured to pivot the upper transport roller 170A about a support axis 204A to the retracted position in response to movement of the card support member 180 from the lowered position to the raised position, as discussed above with reference to FIGS. 11-14.

In some embodiments, the card feed mechanism 126 includes a lower transport roller 172A, and the card substrate 112 is pinched between the transport rollers 170A and 172A when the card substrate 112 is in the lowered position, such as shown in FIGS. 2 and 11. In some embodiments, the pivotable support 200A of the retraction mechanism 190 is biased to pivot the upper transport roller 170A about the first support axis 204A toward the top surface 178 of the card substrate 112 when the card substrate 112. In some embodiments, the transport rollers 170A and 172A form a first pinch roller pair 168A that is configured to pinch the card substrate 112 in the lowered position adjacent a first edge 207 of the card substrate 112.

In some embodiments, the card feed mechanism 126 includes a second pinch roller pair 168B that includes upper and lower transport rollers 170B and 172B, which pinch the card substrate 112 in the lowered position at a second edge 208 of the card substrate 112 that is opposite the first edge 207, as shown in FIG. 2.

In some embodiments, the upper transport roller 170B includes a feed position when the card substrate 112 is in the lowered position, as shown in FIGS. 2 and 11, and a retracted position when the card substrate is in the raised position, as shown in FIGS. 8 and 14. The upper transport roller 170B engages the top surface 178 of the card substrate 112 when in the feed position, and the upper transport roller 170B is on the bottom side of the stack support 124 when in the retracted position, as shown in FIGS. 2 and 8.

The retraction mechanism 190 is configured to move the upper transport roller 170B between the feed and retracted positions, as discussed above with reference to FIGS. 2-9 and 11-14. In some embodiments, the retraction mechanism 190 includes a second pivotable support 200B that is attached to the card support member 180 and is configured to pivot the upper transport roller 170B about a second support axis 204B to the retracted position in response to movement of the card support member 180 from the lowered position to the raised position.

Additional embodiments are directed to a method of performing a substrate stacking operation using the card stacker 104 formed in accordance with one or more embodiments described herein. In one embodiment of the method, a card substrate 112 is received using a card feed mechanism 126 of the card stacker 104 that includes a transport roller 170, such as shown in FIGS. 1 and 2. The card substrate 112 is supported in a lift position (FIG. 2) in a card path 130 on a bottom side 194 of the stack support 124. In some embodiments, a top surface 178 of the card substrate 112 that faces the bottom side 194 of the stack support 124 is engaged with the upper transport roller 170 (e.g., roller 170A), in a feed position, as shown in FIG. 2. The card substrate 112 is then raised from the lift position to a raised position, in which the card substrate 112 is positioned on the bottom of the stack of card substrates 136 and supported on the top side 192 of the stack support 124 using a card lift mechanism 124, as discussed above with reference to FIGS. 2-8 and 11-14. During the lifting or stacking operation, the transport roller 170 is moved from the feed position to a retracted position, in which the transport roller is positioned on the bottom side 194 of the stack support 124.

It is appreciated that certain features of the present disclosure, which are, for clarity, described in the context of separate embodiments, may also be provided in combination in a single embodiment. Conversely, various features of the present disclosure, which are, for brevity, described in the context of a single embodiment, may also be provided separately or in any suitable subcombination or as suitable in any other described embodiment of the present disclosure. Certain features described in the context of various embodiments are not to be considered essential features of those embodiments, unless the embodiment is inoperative without those elements.

Although the embodiments of the present disclosure have been described with reference to preferred embodiments, workers skilled in the art will recognize that changes may be made in form and detail without departing from the spirit and scope of the present disclosure.

What is claimed is:

1. A card stacker for use with a card production device and configured to deliver a card substrate to a bottom of a stack of card substrates, the card stacker comprising:

a stack support configured to hold the stack of card substrates on a top side of the stack support that is opposite a bottom side of the stack support;

a card lift mechanism configured to support the card substrate in a lift position on the bottom side of the stack support, and drive the card substrate to a raised position, in which the card substrate is positioned at the bottom of the stack of card substrates and is supported by the top side of the stack support;

a card feed mechanism comprising a first transport roller having a feed position when the card substrate is in the lift position, and a retracted position when the card substrate is in the raised position, wherein:

the first transport roller engages a top surface of the card substrate that faces the bottom side of the stack support when in the feed position; and when in the retracted position, the first transport roller is displaced from a lifting path of the card substrate defined between the lift and raised positions; and a retraction mechanism configured to move the first transport roller between the feed and retracted positions.

2. The card stacker of claim 1, wherein the card lift mechanism includes:

a card support member; and a drive mechanism configured to drive the card support member between a lowered position corresponding to the lift position of the card substrate and a raised position corresponding to the raised position of the card substrate.

3. The card stacker of claim 2, wherein the retraction mechanism includes a first pivotable support attached to the card support member and configured to pivot the first transport roller about a first support axis to the retracted position in response to movement of the card support member from the lowered position to the raised position.

4. The card stacker of claim 3, wherein the card feed mechanism includes a second transport roller, and the card substrate is pinched between the first and second transport rollers when the card substrate is in the lift position.

5. The card stacker of claim 4, wherein the pivotable support is biased to pivot the first transport roller about the first support axis toward the top surface of the card substrate when the card substrate is in the lift position.

6. The card stacker of claim 5, wherein:

the first and second transport rollers form a first pinch roller pair configured to pinch the card substrate in the lift position adjacent a first edge of the card substrate; and the card feed mechanism includes a second pinch roller pair comprising third and fourth transport rollers, wherein the card substrate in the lift position is pinched between the third and fourth transport rollers at a second edge of the card substrate that is opposite the first edge.

7. The card stacker of claim 6, wherein:

the third transport roller includes a feed position when the card substrate is in the lift position and a retracted position when the card substrate is in the raised position;

the third transport roller engages the top surface of the card substrate when in the feed position;

the third transport roller is displaced from the lifting path of the card substrate when in the retracted position; and the retraction mechanism is configured to move the third transport roller between the feed and retracted positions.

8. The card stacker of claim 7, wherein the retraction mechanism includes a second pivotable support attached to the card support member and configured to pivot the third transport roller about a second support axis to the retracted position in response to movement of the card support member from the lowered position to the raised position.

9. The card stacker of claim 2, wherein the card support member engages a bottom surface of the card substrate that is opposite the top surface and drives the card substrate from the bottom side of the stack support to the top side of the stack support during movement of the card support member from the lowered position to the raised position.

10. The card stacker of claim 9, wherein the stack support comprises a plurality of catch pawls.

11. The card stacker of claim 9, wherein:

the drive mechanism includes a motor and a threaded rod that is received within a threaded bore of the card support member; and the card support member is driven from the lowered position to the raised position in response to rotation of the threaded rod driven by the motor.

12. The card stacker of claim 2, further comprising a first port, through which the card feed mechanism is configured to receive or discharge individual card substrates when the card support member is in the lowered position.

13. The card stacker of claim 12, further comprising a second port, through which the card feed mechanism is configured to receive or discharge individual card substrates when the card support member is in the lowered position, wherein the second port is on an opposing side of the card lift mechanism from the first port.

14. The card stacker of claim 2, wherein:

the card feed mechanism is configured to feed card substrates along a card feed path; and the card stacker includes a card sensor configured to detect a presence or an absence of a card substrate in the card feed path.

15. The card stacker of claim 14, further comprising:

a stack housing having a bottom end supporting the stack support; and a stack sensor configured to sense a top card substrate in the stack of card substrates that is opposite the bottom of the stack of card substrates.

16. A card stacker assembly for use with a card production device and configured to deliver a card substrate to a bottom of a stack of card substrates, the card stacker assembly including a plurality of card stackers each card stacker comprising:

a stack support having a top side configured to hold the stack of card substrates;

a card lift mechanism configured to drive a card substrate from a lowered position on a bottom side of the stack support that is opposite the top side to a raised position, in which the card substrate is positioned at the bottom of the stack of card substrates and is supported by the top side of the stack support; and a card feed mechanism comprising first and second pinch roller pairs respectively configured to receive or discharge individual card substrates along a card path through first and second ports positioned on opposing sides of the card lift mechanism;

wherein:

the plurality of card stackers is positioned in a side-by-side arrangement; and a card substrate discharged through the second port of one of the card stackers is received through the first port of an adjoining card stacker.

17. The card stacker assembly of claim 16, wherein:

the first and second pinch roller pairs each include a transport roller having a feed position when the card substrate is in the lowered position and a retracted position when the card substrate is in the raised position;

the transport roller engages a top surface of the card substrate that faces the bottom side of the stack support when in the feed position;

when in the retracted position, the transport roller is displaced from a lifting path of the card substrate defined between the lowered and raised positions; and each card stacker includes a retraction mechanism configured to move the transport rollers of the first and second pinch roller pairs between the feed and retracted positions.

18. The card stacker assembly of claim 17, wherein each of the retraction mechanisms includes a pivotable support configured to pivot the transport roller about a support axis to the retracted position in response to driving, by the card lift mechanism, of the card substrate from the lowered position to the raised position.

19. A method of adding a card substrate to a bottom of a stack of card substrates supported on a top side of a stack support of a card stacker, the method comprising:

receiving the card substrate with a card feed mechanism of the card stacker, the card feed mechanism including a transport roller;

supporting the card substrate in a lowered position on a bottom side of the stack support including engaging a top surface of the card substrate that faces the bottom side of the stack support with the transport roller in a feed position;

raising the card substrate from the lowered position to a raised position, in which the card substrate is positioned on the bottom of the stack of card substrates and supported on the top side of the stack support, using a card lift mechanism of the card stacker; and during raising the card substrate, moving the transport roller from the feed position to a retracted position, in which the transport roller is displaced from a lifting path of the card substrate defined between the lowered and raised positions.

20. The method of claim 19, further comprising performing a process on the card substrate using a card processing device before receiving the card substrate with the card feed mechanism, wherein the process is selected from the group consisting of:

printing an image on the card substrate;

laminating an overlaminate to the card substrate; and encoding data to the card substrate.

* * * * *